US005653384A

United States Patent [19]

Shaikh

[11] Patent Number: 5,653,384

[45] Date of Patent: Aug. 5, 1997

[54] RE-CLOSABLE CARTON AND BLANK THEREFOR

[75] Inventor: Mahmood Ahmed Shaikh, Cincinnati, Ohio

[73] Assignee: Lawson Mardon Packaging Inc., Mississauga, Canada

[21] Appl. No.: 579,354

[22] Filed: Dec. 27, 1995

[51] Int. Cl.[6] ..... B65D 5/54

[52] U.S. Cl. ..... 229/225; 229/145; 229/905

[58] Field of Search ..... 229/145, 224, 229/225, 228, 905

[56] References Cited

U.S. PATENT DOCUMENTS

| | | | |
|---|---|---|---|
| 3,282,492 | 11/1966 | Vergobbi | 229/225 |
| 3,642,194 | 2/1972 | Scully | 229/225 |
| 3,653,582 | 4/1972 | Scully | 229/225 |
| 3,942,712 | 3/1976 | Bundy et al. | 229/225 |
| 3,963,173 | 6/1976 | Stone | 229/225 |
| 4,284,197 | 8/1981 | Meyers . | |
| 4,289,240 | 9/1981 | Mueller . | |
| 4,310,093 | 1/1982 | Manser | 229/225 |
| 5,058,748 | 10/1991 | Giblin et al. . | |
| 5,161,734 | 11/1992 | Ruehl et al. | 229/227 |
| 5,265,799 | 11/1993 | Stone | 229/225 |
| 5,314,114 | 5/1994 | Stone | 229/225 |
| 5,322,215 | 6/1994 | Roccaforte | 229/225 |

FOREIGN PATENT DOCUMENTS

| | | | |
|---|---|---|---|
| 301111 | 5/1968 | Sweden | 229/225 |

*Primary Examiner*—Gary E. Elkins
*Attorney, Agent, or Firm*—Lane, Aitken & McCann

[57] ABSTRACT

A re-closable parallelepiped carton formed from a unitary sheet of creased and folded laminar material comprises a front panel, opposed side panels and a rear panel all equal in height, a bottom panel, and a lid formed by a top panel hingedly attached to an upper edge of the rear panel. The lid has integral front and side skirt members depending from front and side edges, respectively, of the top panel to extend outside the respective front and side panels for a relatively short part of said height. A front web member extends between an upper edge of the front panel and a lower edge portion of the front skirt member. The front web member comprises a longitudinal linear frangible zone, and upper and lower web portions above and below, respectively, the frangible zone. The upper web portion is formed from an outwardly and downwardly folded extension of the front panel. The lower web portion is formed from an extension of the front skirt member folded upwardly and inwardly and adhered to the inner surface of the front skirt member. Lifting of the lid a first time severs the web member along the frangible zone separating the upper and lower web portions. Upon subsequent re-closure of the lid, the lower web portion engages beneath the upper web portion to lock the lid in the closed position. Preferably, the upper web portion is urged outwardly from the panel by resilience of the material of the fold between the upper web portion and the front panel. Similar web members may be provided along the sides of the carton, improving the reliability of the locking action and assisting in sealing the carton on all sides to inhibit ingress of moisture. The invention also encompasses a laminar blank for forming such a re-closable folded carton.

2 Claims, 8 Drawing Sheets

RE-CLOSABLE CARTON AND BLANK THEREFOR

BACKGROUND OF THE INVENTION

1. Technical Field

The invention relates to re-closable cartons of folded paperboard or other laminar material, such as are used for storing and dispensing soap powder, detergent and like powdered or granular materials; and to blanks for making such cartons.

2. Background Art

Cartons for granular or powdered material, for example detergents, usually are made by die-cutting and creasing a blank of paperboard or the like to define front, rear and side panels and top and bottom flaps. The blank is partially folded but shipped and stored flat. Prior to filling, the sides are folded at the creases to form a rectangular tube and the flaps at one end are folded and glued to form an open box. Once filled, the flaps at the other end are folded and glued to seal the carton and keep its contents dry.

Some early designs of carton had tear lines defining a tab which the user would force inwards to rupture the tear lines and make an opening through which to pour the detergent. The user could tear back the end of the carton top in order to obtain faster flow. A disadvantage of such cartons is that they did not re-close properly and did not provide good access for a scoop to dispense the detergent.

More recently, cartons have been provided with "tear strips" to make them easier to open. Typically, a pair of parallel slits in the exterior surfaces of the front and side walls define between them a "tear strip" of paperboard a short distance below the top edge of the carton. An internal plastic strip underlying the strip of paperboard has one end protruding to enable a user to grasp and pull it to tear away the tear strip. The portion of the carton above the tear strip forms a hinged lid which remains attached to the rear wall and hinges about the upper rear corner. A disadvantage of such cartons is that they can only be filled to the level of the bottom of the tear strip, which wastes space and incurs unnecessary costs.

It is known to overcome the problem of reduced fill level by providing a liner in the form of a rectangular paperboard tube which is the full height of the carton, as disclosed in U.S. Pat. No. 5,058,748 (Giblin et al) issued Oct. 22, 1991. After the tear strip has been removed and the top hinged open, the liner protrudes above the torn edges of the front and side walls allowing the carton to be filled to capacity.

U.S. Pat. No. 5,161,734 (Ruehl et al) discloses an alternative solution which provides double-layer front and side panels. The tear strip is provided in the outer layers of the front and side panels. When the tear strip is removed, the top panel and portions of the front and side panels depending from it form a lid which hinges open about the top crease of the rear panel. The inner layers remain the full height ensuring maximum fill level. In order to provide a positive locking arrangement to retain the lid when reclosed, despite repeated opening and closing of the carton, Ruehl et al's carton has a locking tab formed depending from the inner front layer to engage a flap adhered to that portion of the outer layer which, when the carton is opened, remains attached to the lid. When the carton is re-closed, the strip engages the lower edge of the locking tab and retains the carton closed. A disadvantage of such known cartons is that the use of liners or double-layer panels, and separate tear strips, increases material and production costs.

U.S. Pat. No. 4,289,240 (Mueller) issued Sep. 15, 1981, discloses a flip-lock re-closable carton having a receptacle portion and a hinged cover portion. An extension flap is adhered to the front panel of the carton and splits away from a depending front flap of the cover as the cover is initially opened by a user. A portion of the extension flap remains hingedly attached to the front flap and forms a locking tab which engages in the void from which it was removed to provide a locking action on reclosure. While this carton avoids the expense of a separate, disposable tear strip, it is not entirely satisfactory because its configuration is such that it requires complex machine assembly. Also, none of the above-described cartons has a locking arrangement which can be readily applied to both the front and sides of the carton.

SUMMARY OF THE INVENTION

The present invention seeks to eliminate, or at least mitigate, the disadvantages of the prior art and has for its object to provide a new re-closable carton and blank therefor.

According to one aspect of the invention, a re-closable parallelepiped carton formed from a unitary sheet of creased and folded laminar material comprises a front panel, opposed side panels and a rear panel, all substantially equal in height, a bottom panel, and a lid formed by a top panel hingedly attached to an upper edge of the rear panel and integral front and side skirt members depending from front and side edges, respectively, of the top panel to extend outside the respective front and side panels for a relatively short part of said height, the carton further comprising a front web member extending between an upper edge of the front panel and a lower edge portion of the front skirt member, said front web member comprising a longitudinal linear frangible zone, and upper and lower web portions above and below, respectively, the frangible zone, said upper web portion being formed from an outwardly and downwardly folded extension of the front panel, said lower web portion being formed from an extension of the front skirt member folded upwardly and inwardly and adhered to the inner surface of the front skirt member, the arrangement being such that lifting of the lid a first time severs the web along the frangible zone separating the upper and lower web portions and, upon subsequent re-closure of the lid, said lower web portion engages beneath said upper web portion to lock the lid in the closed position.

According to a second aspect of the present invention, a re-closable parallelepiped carton formed from a unitary sheet of creased and folded laminar material comprises a front panel, opposed side panels and a rear panel, all substantially equal in height, a bottom panel, and a lid, the lid formed by a top panel hingedly attached to an upper edge of the rear panel and integral front and side skirt members depending from front and side edges, respectively, of the top panel to extend outside the respective front and side panels for a relatively short part of said height, the carton further comprising an elongate front web member extending between an upper edge of the front panel and a lower edge portion of the front skirt member, and a pair of elongate side web members each extending between an upper edge of a respective one of the side panels and a lower edge portion of the corresponding side skirt member, each web member comprising a longitudinal linear frangible zone, and upper and lower web portions above and below, respectively, the frangible zone, each upper web portion being formed from an outwardly and downwardly folded extension of the respective one of the front and side panels, each lower web portion being formed from an extension of the corresponding one of the front and side skirt members folded upwardly and inwardly and adhered to the inner surface of the corresponding one of the front and side skirt members, the arrangement being such that lifting of the lid a first time severs each web portion along the frangible zone separating the upper and lower web portions and, upon subsequent re-closure of the lid, each lower web portion engages beneath the corresponding upper web portion to lock the lid in the dosed position.

Advantageously, provision of similar web portions along the front and the sides of the carton improves the reliability of the locking action and assisting in sealing the carton on all sides to inhibit ingress of moisture.

Preferably, in embodiments of either of the above aspects of the invention, each upper web portion is urged outwardly from the panel by resilience of the material of the fold between the upper web portion and the panel.

According to a third aspect of the invention, a blank for forming a re-closable folded carton of the second aspect of the invention comprises a unitary single piece of laminar material subdivided by slits and creases to define;

in line, a rear panel, a front panel and first and second side panels, each panel being rectangular, each neighbouring pair of panels being joined by a fold crease, four bottom closure flaps extending from respective bottom edges of the front, rear, first side and second side panels with a fold crease between each panel and the associated closure flap, a rear top closure flap attached to the upper edge of the rear panel by a rear hinge fold crease, front, first side and second side closure flaps, between the front closure flap and the front panel, an elongate front skirt member and an elongate front web member, the front skirt member being attached along one longitudinal edge to the front closure flap by a fold crease and along its opposite longitudinal edge to one longitudinal edge of the front web member by a fold crease, the opposite longitudinal edge of the front web member being attached to the front panel by a reverse fold crease, a longitudinal linear frangible zone being provided along the web member, the frangible zone defining an upper web portion attached to the front panel and a lower web portion attached to the front skirt member.

According to a fourth aspect of the invention, a blank for producing a folded carton of the first aspect of the invention comprises a unitary single piece of laminar material subdivided by slits and creases to define;

in line, a rear panel, a front panel and first and second side panels, each panel being rectangular, each neighbouring pair of panels being joined by a fold crease, four bottom closure flaps extending from respective bottom edges of the front, rear, first side and second side panels with a fold crease between each panel and the associated closure flap, a rear top closure flap attached to the upper edge of the rear panel by a rear hinge fold crease, front, first side and second side closure flaps, between the front closure flap and the front panel, an elongate front skirt member and an elongate front web member, the front skirt member being attached along one longitudinal edge to the front closure flap by a fold crease and along its opposite longitudinal edge to one longitudinal edge of the front web member by a fold crease, the opposite longitudinal edge of the front web member being attached to the front panel by a reverse fold crease, between each side closure flap and the corresponding side panel, an elongate side skirt member and an elongate side web member, the side skirt member being attached along one longitudinal edge to the side closure flap by a fold crease and along its opposite longitudinal edge to one longitudinal edge of the side web member by a fold crease, the opposite longitudinal edge of the side web member being attached to the side panel by a reverse fold crease, a longitudinal linear frangible zone being provided along each of the front and side web members, each frangible zone defining an upper web portion attached to the respective one of the front and side panels and a lower web portion attached to the respective one of the front and side skirt members.

Various objects, aspects, features, aspects and advantages of the present invention will become more apparent from the following detailed description, taken in conjunction with the accompanying drawings, of a preferred embodiment of the invention, which is described by way of example only.

DESCRIPTION OF THE PREFERRED EMBODIMENT

Figure 1:
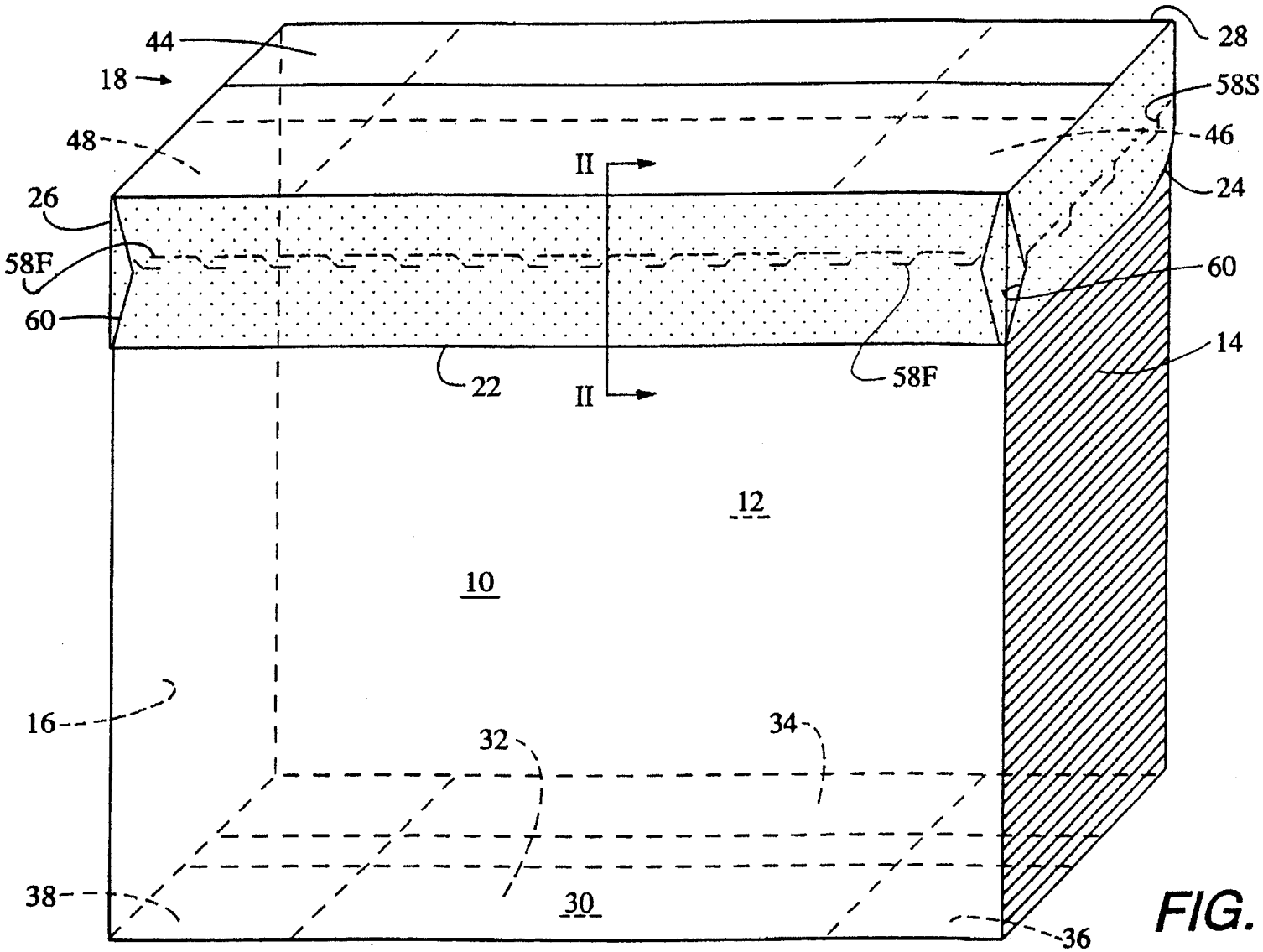
FIG. 1 shows a carton embodying the invention prior to being opened for the first time.
Figure 2:
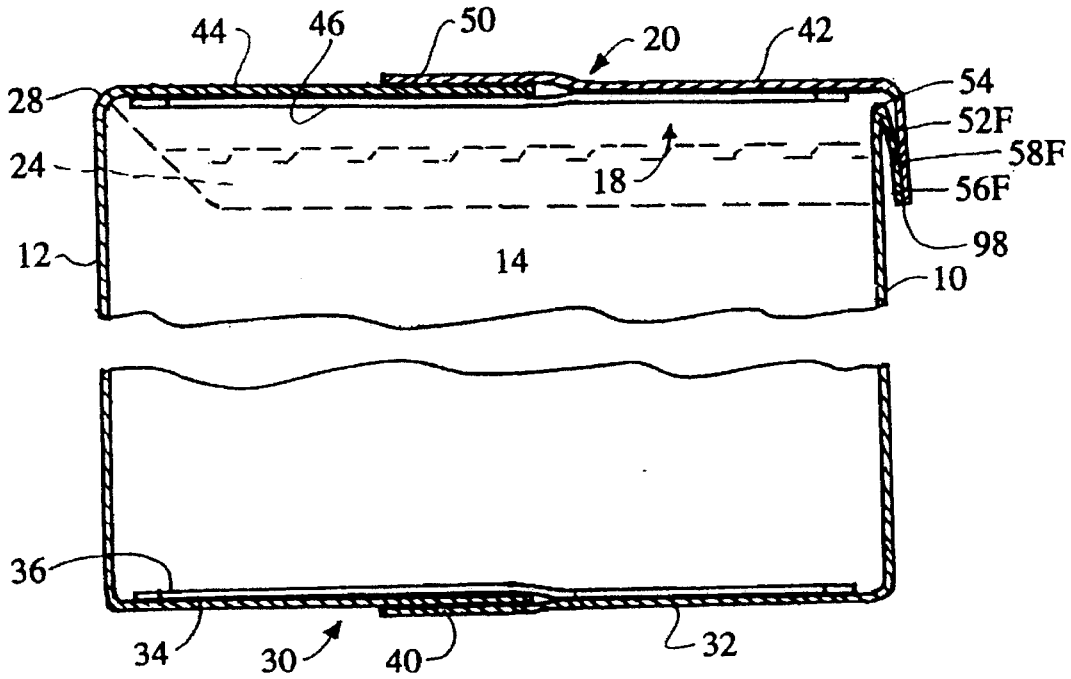
FIG. 2 is a cross-sectional detail view on line II—II of a lid portion of the carton of FIG. 1.

Referring to FIGS. 1 to 4, a six-sided, generally parallelepiped re-closable carton for detergent or other granular or powdered material comprises a front panel 10, rear panel 12, side panels 14 and 16, which are all the same height. A carton lid 18 is formed by a top panel 20 and three skirt portions 22, 24 and 26 which depend from front and sides, respectively, of the top panel 20. The top panel 20 is hingedly connected to the rear panel 12 by a fold crease 28 which permits the top panel 20 to pivot about the fold crease 28 to open and close the lid 18.

The bottom panel 30 of the carton is formed by four flaps 32, 34, 36 and 38 which are extensions of the four panels and are folded inwards about fold creases in conventional manner. A marginal strip 40 (see FIG. 2) of the front bottom flap 32 is embossed to fit over rear bottom flap 34. Likewise, the top panel 20 is formed from four flaps 42, 44, 46 and 48 which are folded inwards in like manner, a marginal strip 50 of front top flap 42 being embossed to overlie rear top flap 44. The rear top flap 44 is an extension of the rear panel 12 and connected to it by the fold crease 28. The front top flap 42, however, is not connected directly to the front panel 10. Rather, the front top flap 42 is connected to the panel 10 by the front skirt portion 22 by a front web which has an upper web portion 52F connected to the upper edge of the front panel 10 by a fold crease 54 and a lower web portion 56F connected to the lower edge of the skirt portion 22.

The upper web portion 52F and lower web portion 56F are connected together along their length by a linear frangible zone 58F conveniently formed by scores or partial perforations. The web portion 56F below the frangible zone 58F is adhered to the juxtaposed inner surface of the front skirt portion 24, whereas the upper web portion 52 above the frangible zone 58F depends from the upper edge of front panel 10, and can flex relative to the front panel 10 about fold crease 54. Similar web portions 52S and 56F, joined by linear frangible zone 58S, are provided between the side panels 14 and 16 and respective skirt portions 24 and 26. Thus, when the carton has been assembled and filled, but not opened for the first time, the web portions extend around the three sides of the carton which is completely sealed. Notches 60 are provided in the respective ends of the web portions adjacent the front corners of the carton to facilitate folding.

Figure 4:
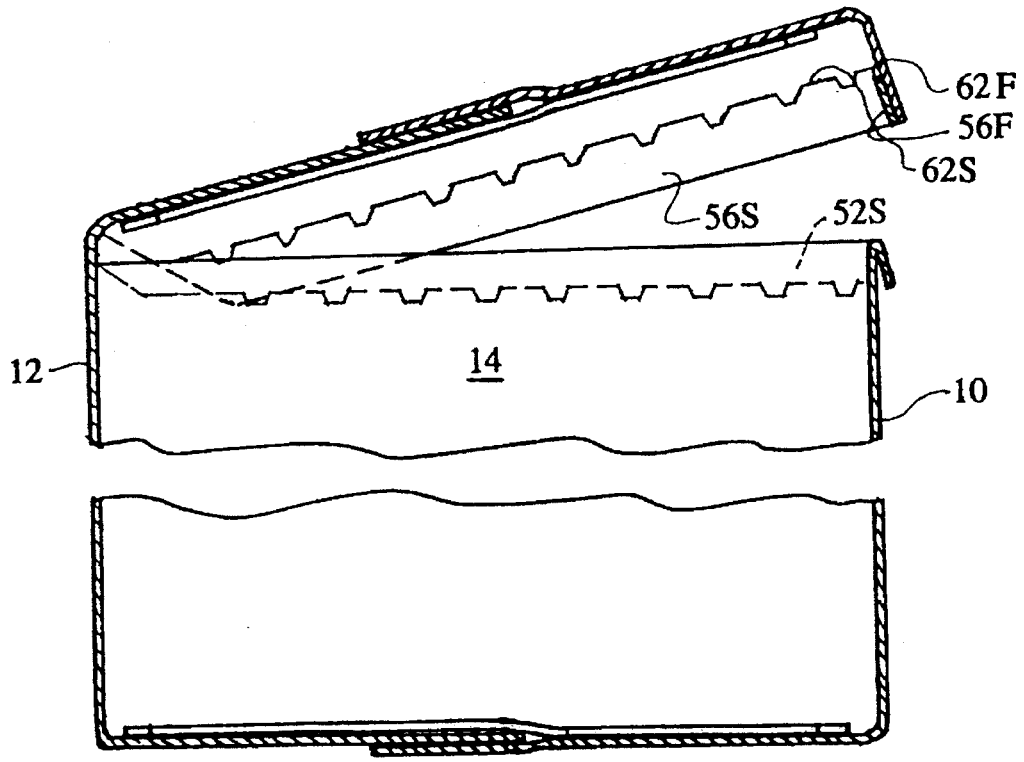
FIG. 4 is a cross-sectional view on line IV—IV of the carton after it has been opened for the first time.
Figure 3:
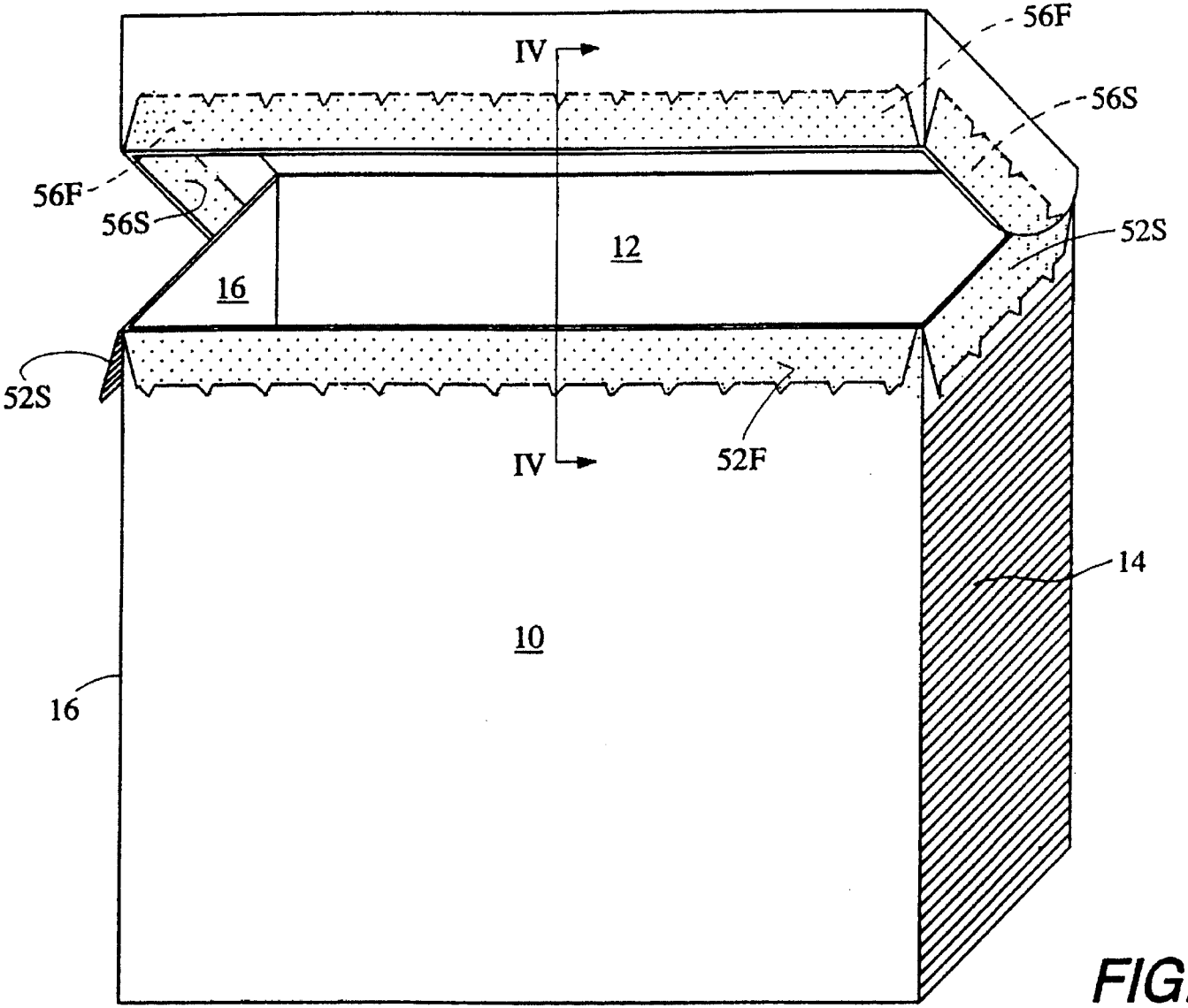
FIG. 3 shows the carton after it has been opened for the first time.

In order to open the carton for the first time, the user grasps the lid 18 by the skirt and pulls it upwards firmly to sever the web portions along the frangible zones. As shown in FIGS. 3 and 4, the lower web portions 56F, 56S remain attached to the inner surfaces of the skirt members and provide a lip 62F, 62S. The upper web portions 52F, 52S flex outwards due to the natural resilience of the material at the fold 54, and form locking tabs which engage lips 62F, 62S to lock the carton when re-closed. Provision of the locking tabs on both the front and the sides improves the sealing of the carton when it is re-closed and increases reliability of the locking mechanism which must survive repeated opening and closing of the carton.

Figure 5:
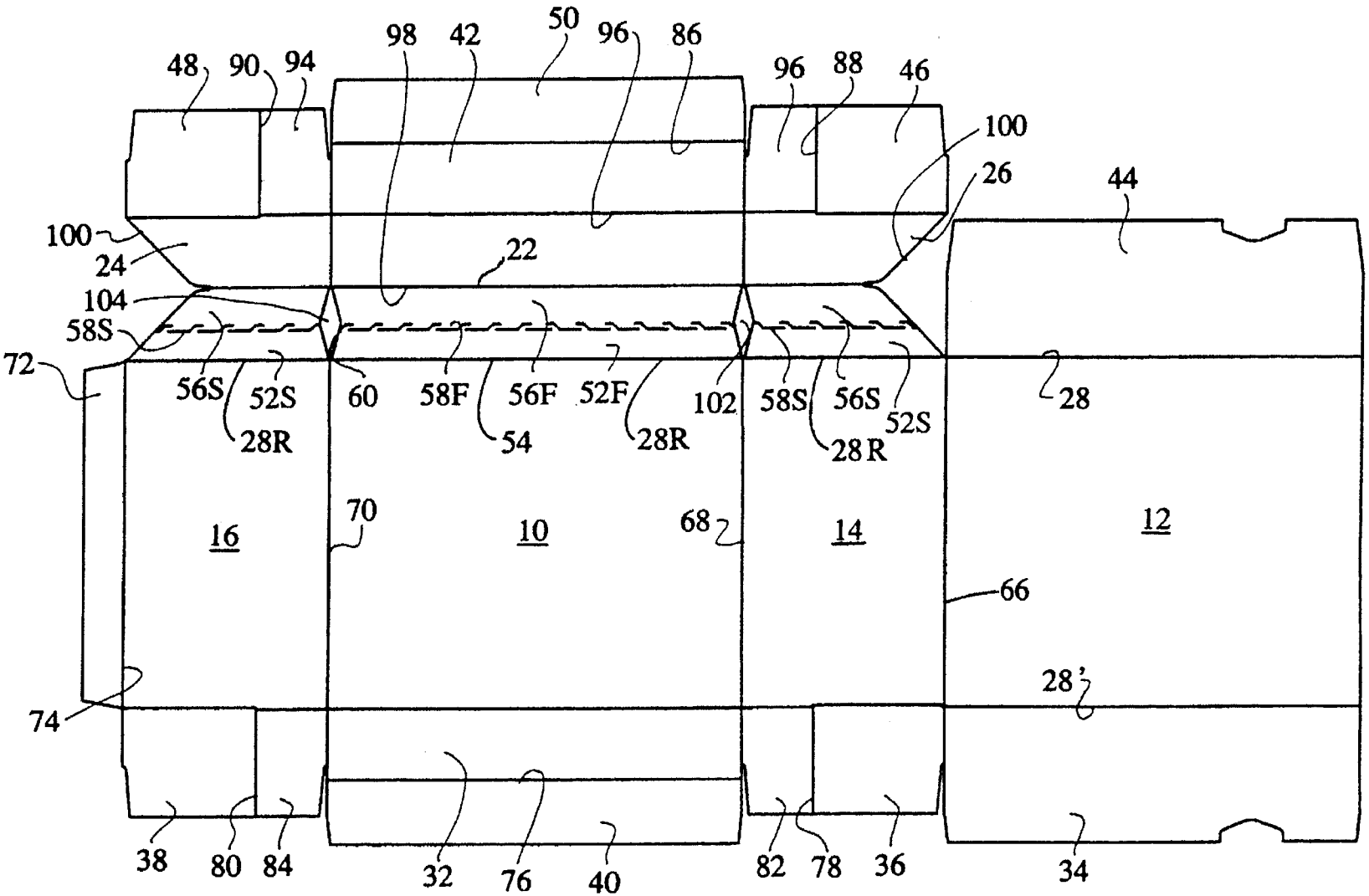
FIG. 5 shows a paperboard blank slit and creased ready for folding to from the carton of FIG. 1.

The carton can be formed, advantageously using a right-angle gluing and folding process, from the unitary blank shown in FIG. 5. As shown in FIG. 5, a pair of parallel, longitudinal fold creases 28 and 28' define upper and lower edges of the front, rear and side panels 10, 12, 14 and 16, respectively, which are separated from each other by transverse fold creases 66, 68 and 70. A gluing tab 72 projects from the outer or free edge of side panel 16, being joined to it by fold crease 74. Rear bottom flap 34 and rear top flap 44 extend from respective upper and lower edges of rear panel 12. Likewise, front bottom flap 32, and side flaps 36 and 38, extend from lower edges of their respective front and side panels 10, 14 and 16. A medial longitudinal ridge 76 constitutes the transition between the embossed outer marginal strip 40 of the bottom flap 32. Transverse ridges 78 and 80 are respective edges of embossed portions 82 and 84 of bottom side flaps 36 and 38.

Likewise, a medial longitudinal ridge 86 defines the edge of the embossed area of front top flap 42. Transverse ridges 88 and 90 define respective edges of the embossed portions 92 and 94 of the top side flaps 44 and 46.

Lower (as shown) edges of top front flap 42 and top side flaps 44 and 46 are defined by a longitudinal fold crease 96 which joins them to their respective skirt portions 22. The skirt portions 22 comprise elongate rectangular strips which are joined to the lower web portions 56F and 56S by an outside (on the reverse face as shown) cut-score 98. As previously described, lower web portions 56F and 56S are joined to upper web portions 52F and 52S by linear frangible zones 58F and 58S which are shown to comprise a series of short cut-scores, each joggled at one end to extend alongside an end portion of its neighbour, forming a so-called "zipper". The cut-scores do not penetrate completely through the material but are deep enough that the frangible zone will tear cleanly when required.

The upper web portions 52F and 52S are joined to respective upper edges of front and side panels 10, 14 and 16 by a reverse crease portion 28R of fold crease 28, i.e. for folding oppositely to the portion between rear panel 12 and top rear flap 44.

Ends of each side web 56S and associated side skirt portion 24, 26 are cut obliquely to form a V-shaped notch 100 which, when the carton is assembled, forms an oblique lower rear edge of the lid 18. The front skirt portion 22 and side skirt portions 24, 26 are joined by fold creases. Through holes 102 and 104 are cut in the blank between the reverse crease 28R and the outside cut score 98. Also, the ends of the front web are notched inwards, with the apex of the notch at the frangible line 58F to form notches 60. Such notches 60 provide clearance at the corners when the carton is folded and clearance for the locking tabs to function during use.

Figure 6:
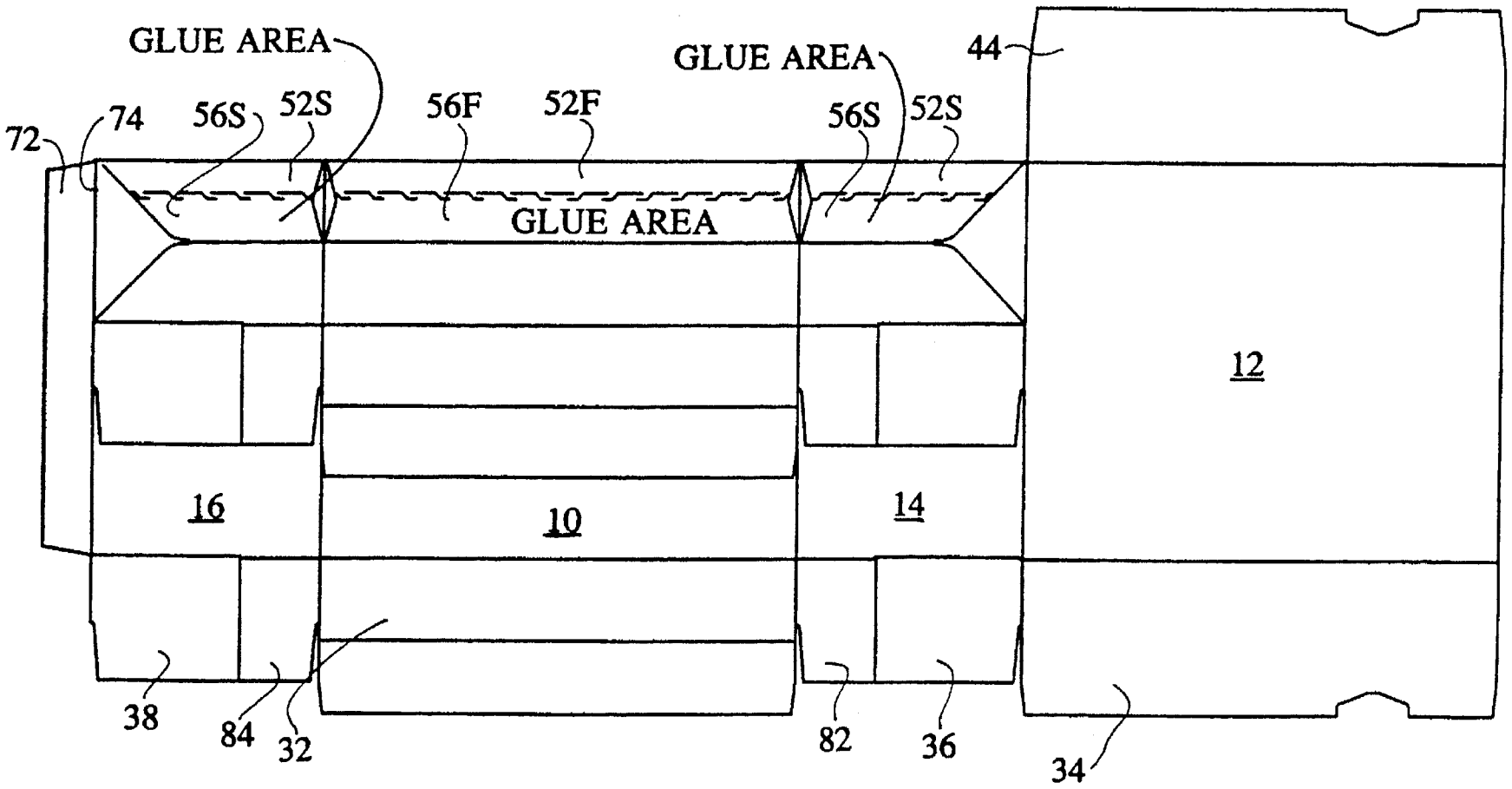
FIGS. 6 through 9 show the blank at various stages of assembly.

In order to assemble the carton, the blank is folded and glued as follows:

Step 1: The section comprising top front and side closure flaps 42, 46 and 48, lid skirt portions 22, 24 and 26, and web portions 56F/56S and 52F/52S, is folded about reverse crease 28R to the position as shown in FIG. 6.

Step 2: Glue is applied to the web portions 56F and 56S between the linear frangible zones 58F and 58S and the reverse crease 28R.

Figure 7:
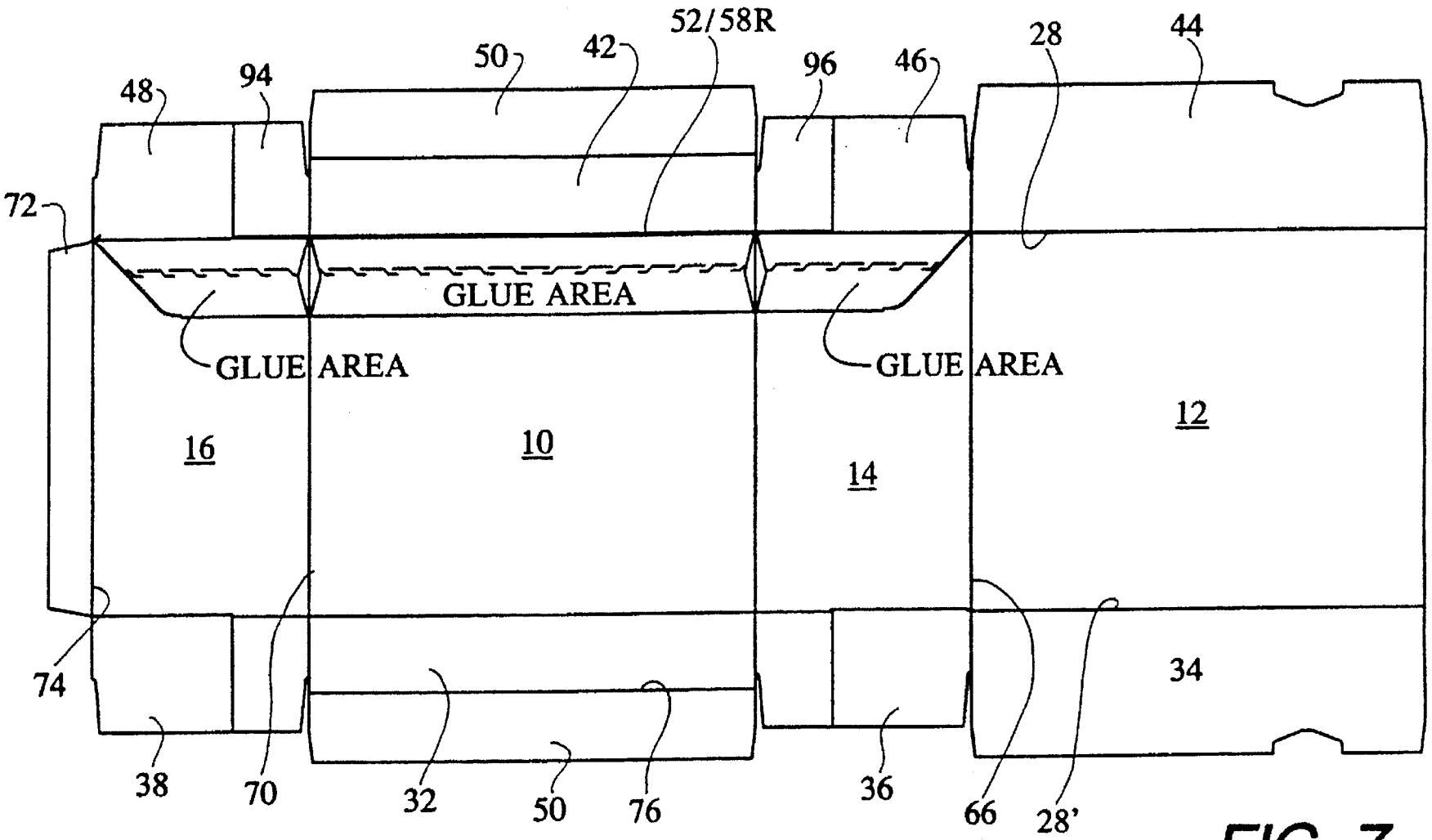

Step 3: The section comprising top closure flaps 42, 46 and 48 and lid skirt portions 22, 24 and 26 is folded back along the cut-score 98 and pressure is applied to bond the glued web portions 56F and 56S to the underlying lid skirt portions 22, respectively, as shown in FIG. 7. The fold crease 52 is now superimposed upon the reverse crease 28R.

Figure 8:
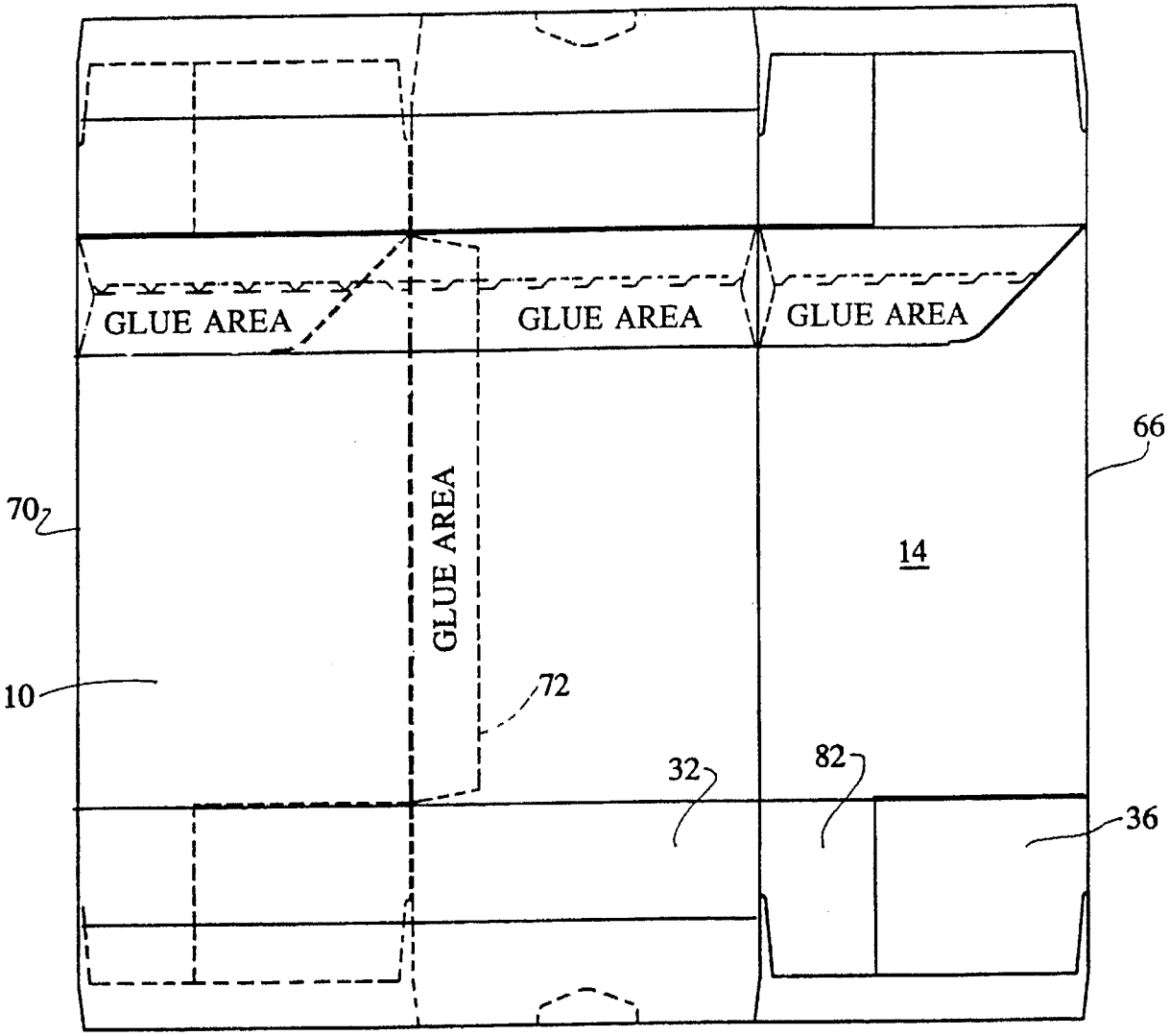
Figure 9:
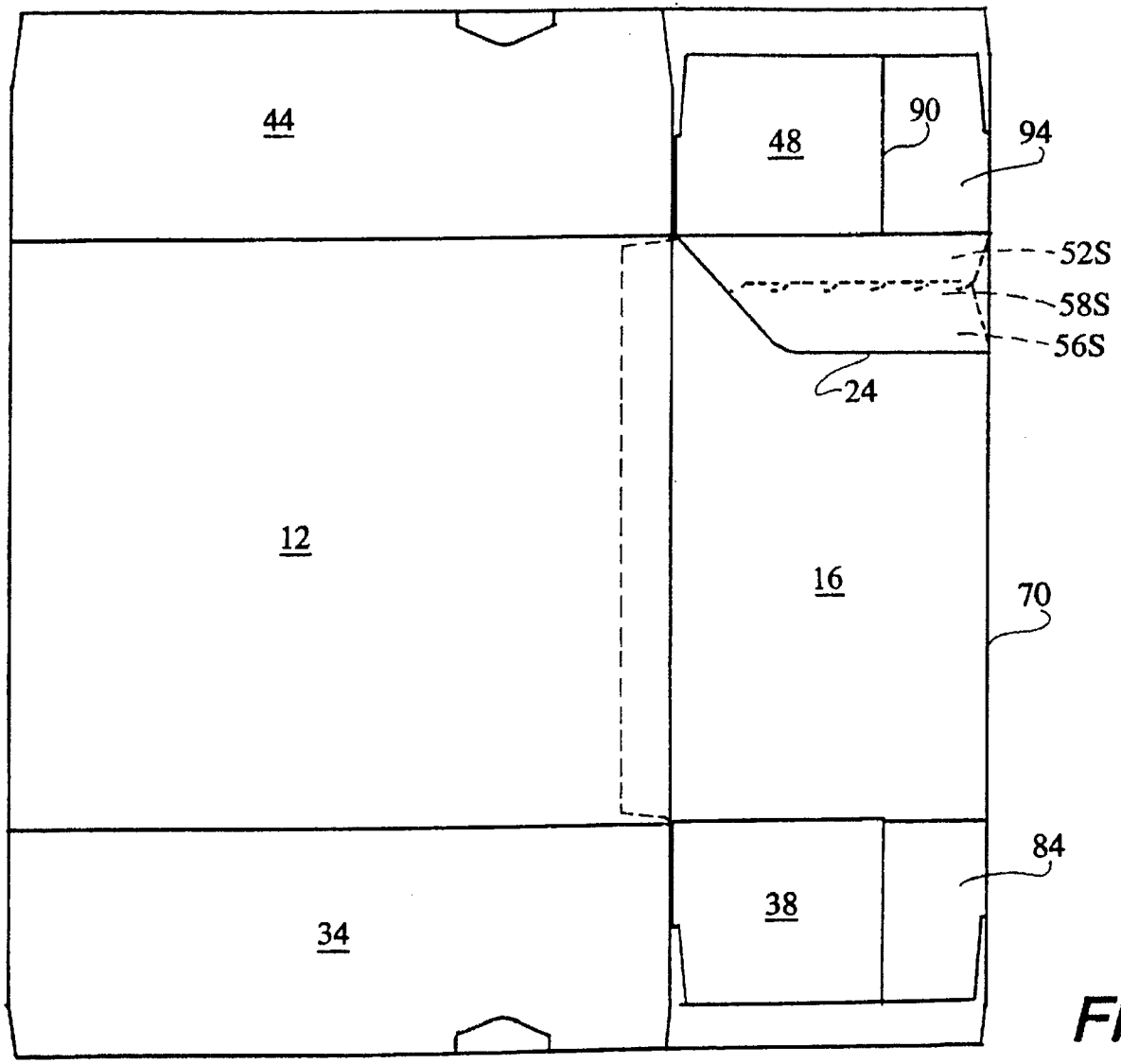

Step 4: Side panel 16 is folded beneath the front panel 10 and glue is applied to the exposed surface of gluing tab 72;

Step 5: The rear panel 12 is folded about transverse crease 66 and pressure is applied to bond its outer edge portion to the glued tab 72. FIGS. 8 and 9 show the front and rear, respectively, of the carton in this condition.

This flat, partially assembled carton can be stacked and shipped to the manufacturer who will complete the assembly and fill and seal the carton as follows:

Step 6: The opposed halves of the carton are opened out to form a rectangular tube and the bottom flaps 32, 34, 36 and 38 are folded inwards in the appropriate sequence and glued together.

Step 7: The carton is filled with detergent and the top flaps 42, 44, 46 and 48 folded inwards in the appropriate sequence and glued.

In this condition, as shown in FIG. 1, the carton is completely sealed against ingress of moisture during shipment to the retailer and storage prior to purchase. As described previously, when the carton has been purchased, the purchaser opens the carton by pulling the lid skirt upwards, rupturing the tear line and severing the upper and lower web portions **52*f*/52S and 56F/56S**.

It should be appreciated that cartons embodying the present invention advantageously can be fried to the very top, since, even after the carton has been opened, the from, rear and side panels are all the same height.

A further advantage is that the carton can be made from a single die-cut blank. Hence, the cost of materials and processing to provide a separate liner are avoided. Yet another advantage is that a separate disposable plastic tear strip, defined by parallel tear lines is avoided, which simplifies production and reduces production cost.

Formation of the locking or detent components and frangible zone as a Z-folded web between the panels and the lid skirt simplifies production and reduces material cost. Also, provision of the locking flaps on front and sides of the carton leads to greater reliability of the locking mechanism during repeated use and improved reseating of the carton.

Various modifications may be made to the above-described embodiment without departing from the scope of the present inventions. For example the glue could be applied to the lower web portions 56F, 56S during or immediately after die-cutting.

It is also envisaged that, to avoid sifting through the cut-score before initial opening, glue could be applied to both upper and lower web portions so that they are both adhered initially to the inside of the skirt portion. Upon initial opening, the webs portions will separate along the frangible zone as before but the upper web portion will delayer leaving an inner layer attached to the front panel to serve as the locking tab and the outer layer adhered to the skirt.

Although an embodiment of the invention has been described and illustrated in detail, it is to be clearly understood that the same is by way of illustration and example only and is not to be taken by way of the limitation, the spirit and scope of the present invention being limited only by the appended claims.

What is claimed is:

1. A re-closable parallelepiped carton formed from a unitary sheet of creased and folded laminar material and comprising a front panel, opposed side panels and a rear panel all substantially equal in height, a bottom panel, and a lid, the lid formed by a top panel hingedly attached to an upper edge of the rear panel and integral front and side skirt members depending from front and side edges, respectively, of the top panel to extend outside the respective front and side panels for a relatively short part of said height, the carton further comprising an elongate front web member extending between an upper edge of the front panel and a lower edge portion of the front skirt member, and a pair of elongate side web members each extending between an upper edge of a respective one of the side panels and a lower edge portion of the corresponding side skirt member, each web member comprising a longitudinal linear frangible zone, and upper and lower web portions above and below, respectively, the frangible zone, each upper web portion being formed from an outwardly and downwardly folded extension of the respective one of the front and side panels, each lower web portion being formed from an extension of the corresponding one of the front and side skirt members folded upwardly and inwardly and adhered to the inner surface of the corresponding one of the front and side skirt members, the arrangement being such that lifting of the lid a first time severs each web portion along the frangible zone separating the upper and lower web portions and, upon subsequent re-closure of the lid, each lower web portion engages beneath the corresponding upper web portion to lock the lid in the closed position.

2. A blank for producing a folded carton, comprising a unitary single piece of laminar material subdivided by slits and creases to define:

in line, a rear panel, a front panel and first and second side panels, each panel being rectangular, each neighboring pair of panels being joined by a fold crease, four bottom closure flaps extending from respective bottom edges of the front, rear, first and second side panels with a fold crease between each panel and the associated closure flap, a rear top closure flap attached to the upper edge of the rear panel by a rear hinge fold crease, front, first side and second side closure flaps, between the front closure flap and the front panel, an elongate front skirt member and an elongate front web member, the front skirt member being attached along one longitudinal edge to the front closure flap by a fold crease and along its opposite longitudinal edge to one longitudinal edge of the front web member by a fold crease, the opposite longitudinal edge of the front member being attached to the front panel by a reverse fold crease, a longitudinal linear frangible zone being provided along the front web member, the frangible zone defining an upper web portion attached to the front panel and a lower web portion attached to the front skirt member; and between each side closure flap and the corresponding side panel, an elongate side skirt member and an elongate side web member, the side skirt member being attached along one longitudinal edge to the side closure flap by a fold crease and along its opposite longitudinal edge to one longitudinal edge of the side web member by a fold crease, the opposite longitudinal edge of the side web member being attached to the side panel by a reverse fold crease, longitudinal linear frangible zones being provided one along each of the side web members, each of said frangible zones defining an upper web portion attached to the respective one of the side panels and a lower web portion attached to the respective one of the side skirt members.

* * * * *